US005379086A

United States Patent [19]

Kuzyk

[11] Patent Number: 5,379,086

[45] Date of Patent: Jan. 3, 1995

[54] AUTOMATIC PHOTO-CHEMICAL REPLENISHMENT WITH BATCH PROCESSING

[76] Inventor: Roman Kuzyk, 110 Sewell Ave., Trenton, N.J.

[21] Appl. No.: 77,407

[22] Filed: Jun. 16, 1993

[51] Int. Cl.[6] ..... G03D 3/02

[52] U.S. Cl. ..... 354/324

[58] Field of Search ..... 354/324, 329, 330, 331, 354/336; 134/64 P, 122 P

[56] References Cited

U.S. PATENT DOCUMENTS

Re. 34,188 3/1993 Kuzyk ..... 354/299
4,289,092 9/1981 McChesney et al. ..... 354/317
4,586,805 5/1986 Bockemühl-Simon et al. .... 354/323
4,890,131 12/1989 Kuzyk et al. ..... 354/323
5,057,858 10/1991 Woog ..... 354/324
5,237,360 8/1993 Patton ..... 354/324
5,270,762 12/1993 Rosenburgh et al. ..... 354/324

*Primary Examiner*—D. Rutledge
*Attorney, Agent, or Firm*—Longacre & White

[57] ABSTRACT

The present disclosure concerns a developing machine for batch processing photographic film and paper. The quality of the chemicals used to develop the film and paper are maintained by a system for automatically replenishing used chemical with a concentrate immediately prior to re-use.

5 Claims, 2 Drawing Sheets

AUTOMATIC PHOTO-CHEMICAL REPLENISHMENT WITH BATCH PROCESSING

BACKGROUND OF THE INVENTION a) Field of the Invention

The so called "wet" processes for developing photographs may be classified as either "continuous" or "batch" processes. In continuous processing, film or paper is moved through a series of separate tanks, each of which contains one chemical. In batch processing, film or paper is loaded into a single drum, and a sequence of chemicals are added and removed from the drum.

Generally, chemical quality is maintained by always using new chemical, or replenishing used chemical with a concentrate. The present invention concerns controlling the quality of the chemicals necessary to ensure proper processing.

The invention more particularly concerns the automatic replenishment of chemicals used to develop photographic film or paper in a batch processing machine.

b) Description of Related Art

It is known that to automatically replenish chemicals in continuous processors, concentrate is added to a processing tank based on the quantity of film or paper which has passed through the processing tank. Batch processors withdraw each chemical from the drum after its participation in developing the film or paper is completed. At present, the withdrawn chemicals are either discarded, or stored in separate containers and manually replenished for reuse.

SUMMARY OF THE INVENTION

An object of the present invention is to provide a machine for developing photographic film and paper. In particular, the present invention combines batch processing of photographic film and paper, with automatic replenishment of the chemicals used to develop a previous batch of photographic film or paper.

Another object of the present invention is to provide a machine for developing photographic film and paper which includes a mechanism for proportionally mixing used chemical with a respective concentrate so as to replenish the used chemical.

DESCRIPTION OF THE PREFERRED EMBODIMENT

Figure 1:
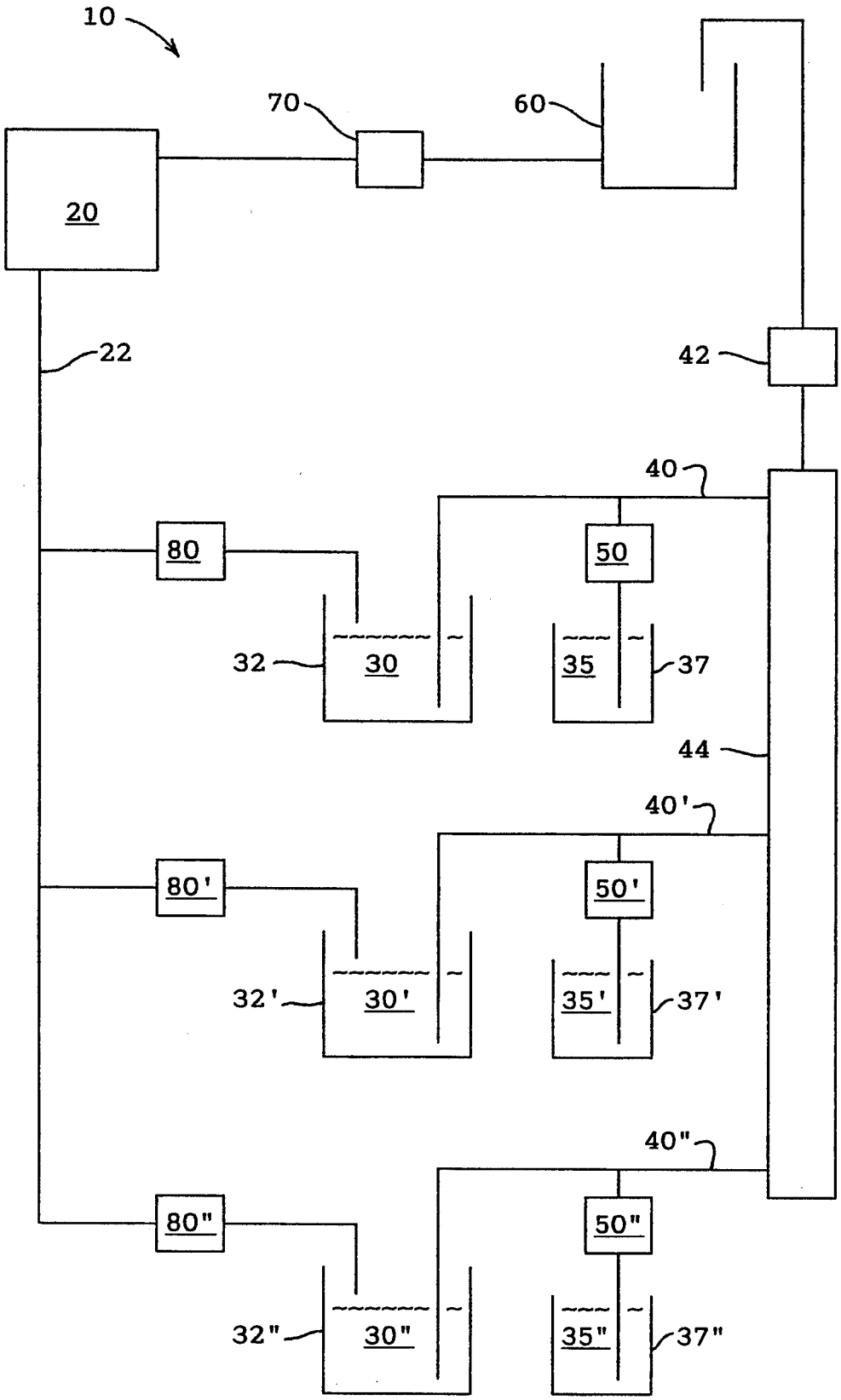
FIG. 1 schematically shows a machine for developing photographic film and paper according to the present invention.

FIG. 1 shows a machine 10 for developing photographic film and paper. Photographic film and paper to be developed are placed inside a developing drum 20. As is well known in the art, the photographic film and paper are developed through the course of reacting with a sequence of chemicals 30,30',30'' For the sake of example, three chemicals 30,30',30'' are discussed herein, however, it is envisioned that the present invention is equally applicable to machines which use more or less than three chemicals.

Each of the chemicals 30,30',30'' used in the developing sequence are stored in respective containers 32,32',32''. The associated concentrates 35, 35',35'' used to replenish each chemical 30,30',30'' are stored in respective vessels 37,37',37''.

Each chemical 30,30',30'' along with its associated concentrate 35,35',35'', may be drawn through a respective section of supply piping 40,40',40'' by a positive displacement means 42. A manifold 44, such as that disclosed in United States Patent Re. 34,188 (which is hereby incorporated with particular reference to FIGS. 6 and 7), may be used to selectively connect one of the sections of supply piping 40,40', 40'' to the developing drum 20 As an alternative to the positive displacement means 42, the force of gravity may be used to accomplish the transfer from the sections of supply piping 40,40', 40'' through the manifold 44

In the embodiment of FIG. 1, the ratio of each chemical 30,30', 30'' drawn from the containers 32,32', 32'' with respect to the concentrate 35,35', 35'' drawn from the vessels 37,37', 37'' is established by a respective proportioning mechanism 50,50', 50''.

The proportioning mechanisms 50,50', 50'' may be metering valves for regulating the withdrawal of each concentrate 35,35', 35'' from the respective vessel 37,37', 37''. The concentrate 35,35', 35'' replenishes the chemical 30,30', 30'' to ensure the chemical 30 30', 30'' is of the necessary quality to properly act upon the photographic film and paper in the developing drum 20. Generally, the quality of the chemical 30,30', 30'' refers to the strength of the chemical, however, it is envisioned that concentrates could also be used to adjust other characteristics of the chemical, for example acidity.

The proportional mixture of chemical 30,30', 30'' and its associated concentrate 35,35', 35'' may be transferred to a thermal treatment assembly 60 before being transferred to the developing drum 20. The thermal treatment assembly 60 adjusts the temperature of the proportional mixture to obtain the correct temperature of the mixture. It is well known that the temperature of the mixture affects the development of the photographic film and paper in the developing drum 20.

Positive displacement means 70, or the force of gravity, may be used to transfer the proportional mixture from the thermal treatment assembly 60 to the developing drum 20.

After the proportional mixture has completed its participation in the development of the photographic film and paper, the mixture is withdrawn from the developing drum 20 through a section of return pipe 22 and returned to an appropriate one of the storage containers 32,32', 32'' for future reuse. Valve means 80,80', 80'', e.g. solenoid valves, may be used to direct the distribution of the mixture in the return pipe 22 to a respective container 32,32', 32''. One advantage of the present invention is the amount of mixture withdrawn from the developing drum 20 may be correlated with the surface area of the photographic film and paper which has been developed.

By replenishing and reusing the chemicals 30,30', 30'' it is possible to significantly improve the efficiency of batch processing. Specifically, rather than disposing of the chemicals 30,30', 30'' after each use, they are replenished with concentrate 35,35', 35'' and reused with a subsequent processing batch. Further, because the chemicals 30,30', 30'' and concentrates 35,35', 35'' are proportionally mixed by the proportioning mechanisms 50,50′, 50″ immediately prior to use, deterioration of the chemicals 30,30′, 30″ over time is reduced since the chemicals 30,30′, 30″ are maintained in a less concentrated, and hence less active, state. This latter feature is also advantageous over manual replenishment of the chemicals 30,30′, 30″ since only that portion of the chemicals 30,30′, 30″ which will be used is replenished. Consequently, it is not necessary to replenish the whole of the chemical 30,30′, 30″ in the storage containers 32,32′, 32″, which would simply begin to deteriorate.

Figure 2:
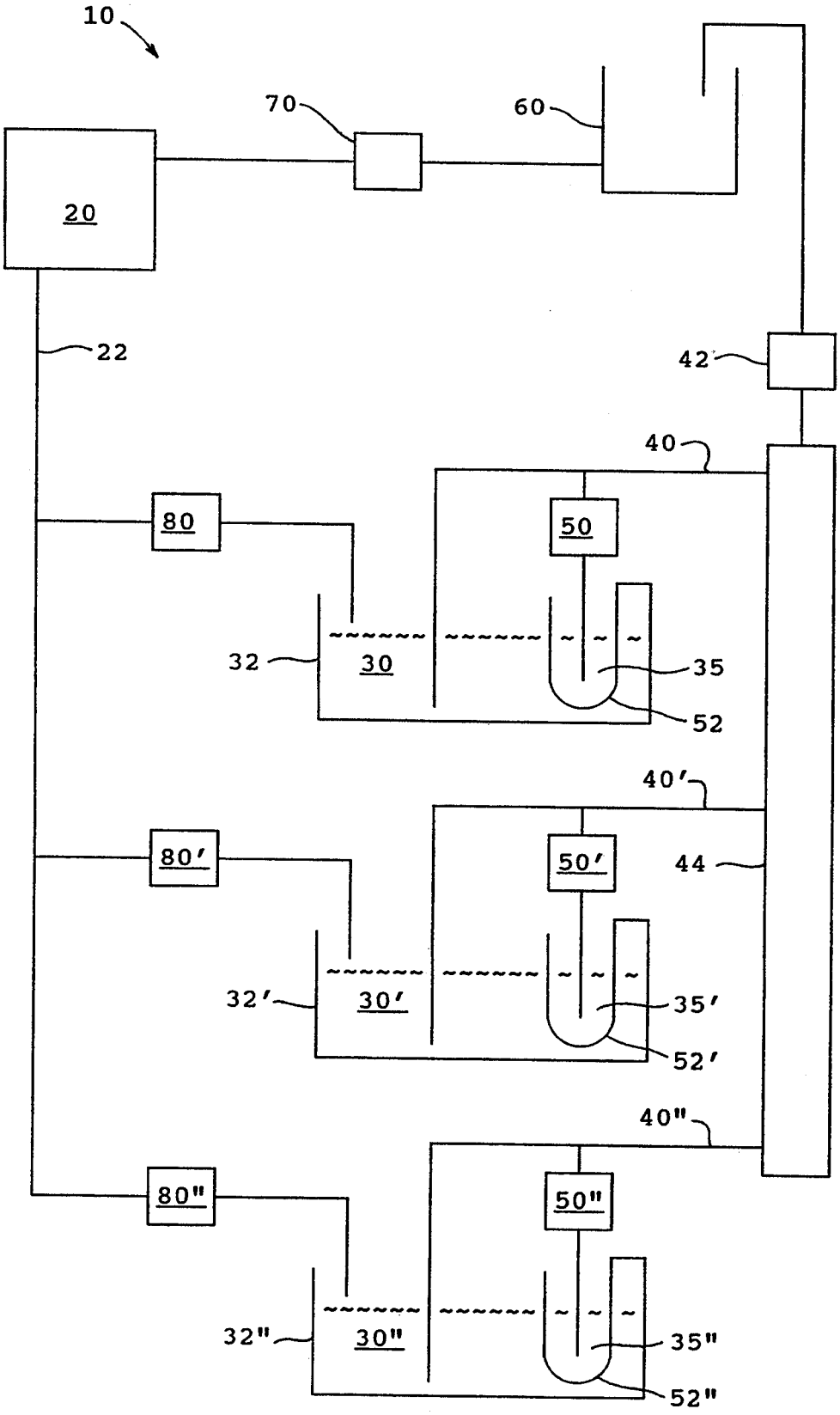
FIG. 2 schematically shows the machine for developing photographic film and paper in FIG. 1 arranged to optimize the operation of the proportioning mechanisms.

In FIG. 2, vessels 37,37′, 37″ have been replaced with expansible bladders 52,52′, 52″ housed within the storage containers 32,32′, 32″. This ensures a uniform pressure head on both the chemical 30,30′, 30″ and the concentrate 35,35′, 35″ thereby optimizing the performance of the proportioning mechanisms 50,50′, 50″.

The present invention is not limited to the embodiments described and shown herein. Rather, the present invention is limited only by the scope of the appended claims.

What is claimed is:

1. A photographic developing means for batch processing photograph film and paper, said photographic developing means comprising:

drum means for sequentially receiving and discharging a plurality of photo-chemicals, said photograph film and paper react to each of said plurality of photo-chemicals inside said drum means;

displacement means for transferring each of said plurality of photo-chemicals between a respective storage container and said drum means;

concentrate means for replenishing a respective one of said plurality of photo-chemicals; and proportioning means for proportionally mixing both concentrate means from a concentrate container and said respective one of said plurality of photo-chemicals from said respective storage container, said proportioning means is connected between said displacement means and said containers.

2. The photographic developing means in claim 1, wherein said proportioning means is a metering valve connected between said concentrate container and said displacement means.

3. A photographic developing means for batch processing photograph film and paper, said photographic developing means comprising:

drum means for sequentially receiving and discharging a plurality of photo-chemicals, said photograph film and paper react to each of said plurality of photo-chemicals inside said drum means;

displacement means for transferring each of said plurality of photo-chemicals between a respective storage container and said drum means;

concentrate means for replenishing a respective one of said plurality of photo-chemicals;

proportioning means for proportionally mixing both concentrate means from a concentrate container and said respective one of said plurality of photo-chemicals from said respective storage container, said proportioning means is connected between said displacement means and said containers; and thermal means for adjusting the temperature of the proportional mix, said thermal means is connected between said drum means and said containers.

4. The photographic developing means in claim 3, wherein said displacement means includes a first positive displacement pump and a second positive displacement pump, said first pump is connected between said thermal means and said containers, and said second pump is connected between said thermal means and said drum means.

5. A photographic developing means for batch processing photograph film and paper, said photographic developing means comprising:

drum means for sequentially receiving and discharging a plurality of photo-chemicals, said photograph film and paper react to each of said plurality of photo-chemicals inside said drum means;

displacement means for transferring each of said plurality of photo-chemicals between a respective storage container and said drum means;

concentrate means for replenishing a respective one of said plurality of photo-chemicals; and proportioning means for proportionally mixing both concentrate means from a concentrate container and said respective one of said plurality of photo-chemicals from said respective storage container, said proportioning means is connected between said displacement means and said containers;

wherein said concentrate container is an expansible bladder means for equalizing pressure in said concentrate container and said respective storage container.

* * * * *